US006421838B1

(12) United States Patent
Frank

(10) Patent No.: US 6,421,838 B1
(45) Date of Patent: Jul. 23, 2002

(54) HAT WITH INTEGRAL ELASTIC HAIR STRAP

(76) Inventor: Kelly Frank, 5700 NW. 42nd Ct., Boca Raton, FL (US) 33496

( * ) Notice: Subject to any disclaimer, the term of this patent is extended or adjusted under 35 U.S.C. 154(b) by 0 days.

(21) Appl. No.: 09/949,099

(22) Filed: Sep. 7, 2001

Related U.S. Application Data

(60) Provisional application No. 60/282,810, filed on Apr. 10, 2001.

(51) Int. Cl.[7] ..... A42B 1/00
(52) U.S. Cl. ..... 2/195.3; 2/174
(58) Field of Search ..... 2/195.3, 174, 171, 2/195.4, 209.13, 209.4, 175.7

(56) References Cited

U.S. PATENT DOCUMENTS 1,002,060 A * 8/1911 Hill ..... 2/174
1,516,796 A * 11/1924 Seilaz ..... 2/174
2,191,589 A * 2/1940 Sacks ..... 2/171
2,519,512 A * 8/1950 Stone ..... 2/171
2,522,251 A * 9/1950 Beguhn ..... 2/174
5,170,509 A 12/1992 Leopold
5,675,841 A * 10/1997 Jackson ..... 2/174.7
5,875,488 A * 3/1999 Milani ..... 2/171
5,966,742 A 10/1999 Cunliffe
6,154,887 A * 12/2000 Yagi ..... 2/175.7
6,240,566 B1 6/2001 Scantlin

* cited by examiner

*Primary Examiner*—Gloria M. Hale
(74) *Attorney, Agent, or Firm*—John C. Smith

(57) ABSTRACT

An integral elastic strap for head wear. The elastic strap is attached to the rear of the head wear. The integral strap is positioned at the rear of the head wear such that when the hair is pulled back, the elastic strap is stretched and twisted around the hair to secure the hair in the form of a pony tail. The head wear can be one of a variety of head wear, such as a conventional hat, a baseball cap, etc. When used in conjunction with head wear that is adjustable in size, such as a baseball cap, the elastic strap also holds the edge of the cap snugly against the wearer's head when the wearer's hair is not being secured, thereby eliminating the need for a conventional securing strap.

18 Claims, 9 Drawing Sheets

HAT WITH INTEGRAL ELASTIC HAIR STRAP

CROSS-REFERENCE TO RELATED APPLICATIONS

This application is a non-provisional patent application which is related to, and claims the benefit of, the commonly owned copending provisional application entitled "Cap With Integral Elastic Hair Strap", filed Apr. 10, 2001, bearing U.S. Ser. No. 60/282,810 and naming Kelly Frank, the named inventor herein, as sole inventor, the contents of which is specifically incorporated herein by reference in its entirety.

TECHNICAL FIELD

The present invention relates to head wear. In particular, it relates to head wear which secures the user's hair in the form of a "pony tail" with an integral elastic hair strap in the rear portion of the cap that wraps around the hair of the user. The head wear can be a conventional hat, a baseball-type cap, or other head garment that allows the wearer's hair to be secured by an elastic strap in the rear portion of the head wear.

BACKGROUND OF THE INVENTION

Presently, individuals with long hair who engage in outdoor activities may have problems controlling their hair due to wind conditions. Wind creates problems due to the constant blowing of the individual's hair in random directions. Likewise, depending on weather conditions, individuals may wish to have their hair pulled up and away from their necks for the purpose of keeping cool. This is typically accomplished by the use of an elastic band, by the use of an ornamental elastic band (commonly referred to as a "scrunchee"), or even by a simple rubber band. Women (or men with long hair) would typically use the elastic band to pull their hair into the form of a "pony tail" and to secure it by twisting the elastic band around the base of the pony tail.

While conventional elastic bands allow individuals to secure their hair in the form of a pony tail, the conventional elastic bands also have drawbacks. In particular, a conventional elastic band is another item, in addition to other things that individuals may carry, which increases the inconvenience of traveling. Further, the individual must remember to take the elastic band, must carry it with any other items which the individual wants, and must secure it to their hair without interfering with any head wear which they may be wearing. It would be desirable for an individual to be able to secure their hair into the form of a pony tail without having the inconvenience of having to remember an additional device and having to carry it with them.

One prior part attempt to address the inconvenience of having to carry conventional elastic bands has been to integrate a scrunchee into the rear portion of a cap. This eliminates the need to carry a separate item, however, it also results in the scrunchee being visibly attached to the rear of the cap even when its use is not needed or desired. On the other hand, if the scrunchee is removably attached to the back of a cap, then the original problem returns in which an additional item must be carried. It would be desirable to have a way to secure an individual's hair without having to carry a removable scrunchee when not needed, and without having a large obtrusive device such as a scrunchee attached to a cap when it is not needed or desired. Further, it would be desirable to have a small unobtrusive device which is integrated into a cap or hat that would be unnoticed when not used, yet available to secure an individual's hair when needed.

Another attempt to address problems associated with control of an individual's hair when wearing a cap has been to eliminate a substantial portion of the rear section of a cap such that conventional hair control devices are not obstructed by the cap.

While the prior art has made attempts to provide a device for securing hair, it has failed to provide a method of securing hair which does not require the user to carry any additional devices, and which can be conveniently available to the user by having a hair control device which is incorporated into articles of apparel or garments that the user is already wearing.

SUMMARY OF THE INVENTION

The present invention solves the foregoing problems by providing head wear with an integral elastic strap attached to the rear of the head wear. The integral strap is positioned at the rear of the head wear. When in use, the hair is pulled back and the elastic strap is stretched and twisted around the hair to secure the hair in the form of a pony tail. The head wear can be a cap, such as a baseball cap, or any other type of hat. When used in conjunction with head wear that is adjustable in size, such as a baseball cap, the elastic strap also holds the edge of the cap snugly against the wearer's head when the wearer's hair is not being secured.

DESCRIPTION OF THE PREFERRED EMBODIMENT

Prior to a detailed discussion of the figures, a general overview of the improved hat will be presented. The hat incorporates a flexible elastic strap which is attached to the rear of a hat which may be a conventional hat, a baseball cap, or other suitable type of head wear. The flexible strap is preferably designed to be permanently attached to the hat such that it is always conveniently available for the user. This eliminates the need for the user to carry a separate elastic band, hair clasp, or other type of hair retaining device.

The flexible strap is attached to the hat at the rear such that when it is in use, it extends so that it can be used in a manner similar to a conventional elastic band. In particular, it is flexible enough such that the wearer can pull the wearer's hair backward to form a pony tail, the hair forming the pony tail can then be secured with the elastic strap by twisting the strap around the hair. If the elastic strap is used in conjunction with a baseball-type cap, then the hair is pulled out through the opening in the back of the cap and the flexible elastic strap is then used to secure the hair. Likewise, if used in conjunction with a conventional hat, the elastic strap can be attached to the brim or the headband, and extended to secure the wearer's hair in a similar manner. As a result, the single flexible strap provided by this invention can be used with almost any type of head wear and does not depend on a particular style of hat or cap.

Those skilled in the art will realize that a variety of modifications can be made to the invention. Since any type of hat can be used with the integral strap presented herein, the flexible elastic strap can be secured to a hat in a variety of locations. In particular, depending on the type of hat, the flexible elastic strap can be concealed when not in use. Further, the material used to fabricate the elastic strap can be anything suitable for its purpose. The elastic strap can also be removably attached (for example, with hook and loop material, snaps, etc) such that it can be easily replaced for fashion reasons with the elastic strap's having different colors and/or designs (for example, insignia for sports teams, etc). Further, by using a removable attachment, such as hook and loop material, the elastic strap can not only be exchanged for other straps with different color patterns, etc., but it can also be used to attach the elastic strap to the rear of the cap such that it is flat against the rear of the cap when not in use.

As a result of incorporating an integral elastic strap into the structure of the hat itself, the wearer is no longer inconvenienced by having to carry a separate hair control device which may be easily forgotten and lost. We turn now to a detailed discussion of the figures.

Figure 1:
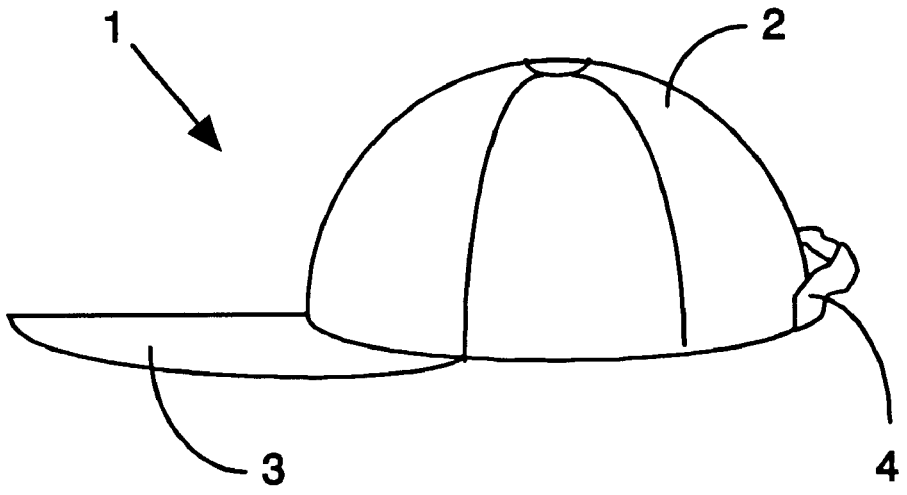
FIG. 1 is a side view of a preferred embodiment of a cap with an integral elastic hair strap attached to the rear of the cap.

FIG. 1 is a diagram that shows a side view of a preferred embodiment of the cap 1 which incorporates the integral elastic hair strap 4 provided by the invention. In this figure, the cap 1 is in the form of a conventional baseball cap which has a hat segment 2 and a brim 3. In addition, it also has a flexible elastic hair strap 4 which is attached to the rear of the cap 1. Those skilled in the art will recognize that while a baseball cap is used to illustrate the invention, other types of head wear can easily implement this invention.

As shown in this figure, the flexible elastic hair strap 4 is in the fully retracted position in which it rests in close proximity to the rear of the cap 1. For ease of illustration, the flexible elastic hair strap 4 is shown slightly extended from the rear of the cap 1. The flexible elastic hair strap 4 can actually function as a decorative element of the cap 1 when it is not in use for its intended purpose. For example, the flexible elastic strap 4 can be used to display team colors, etc.

Figure 2:
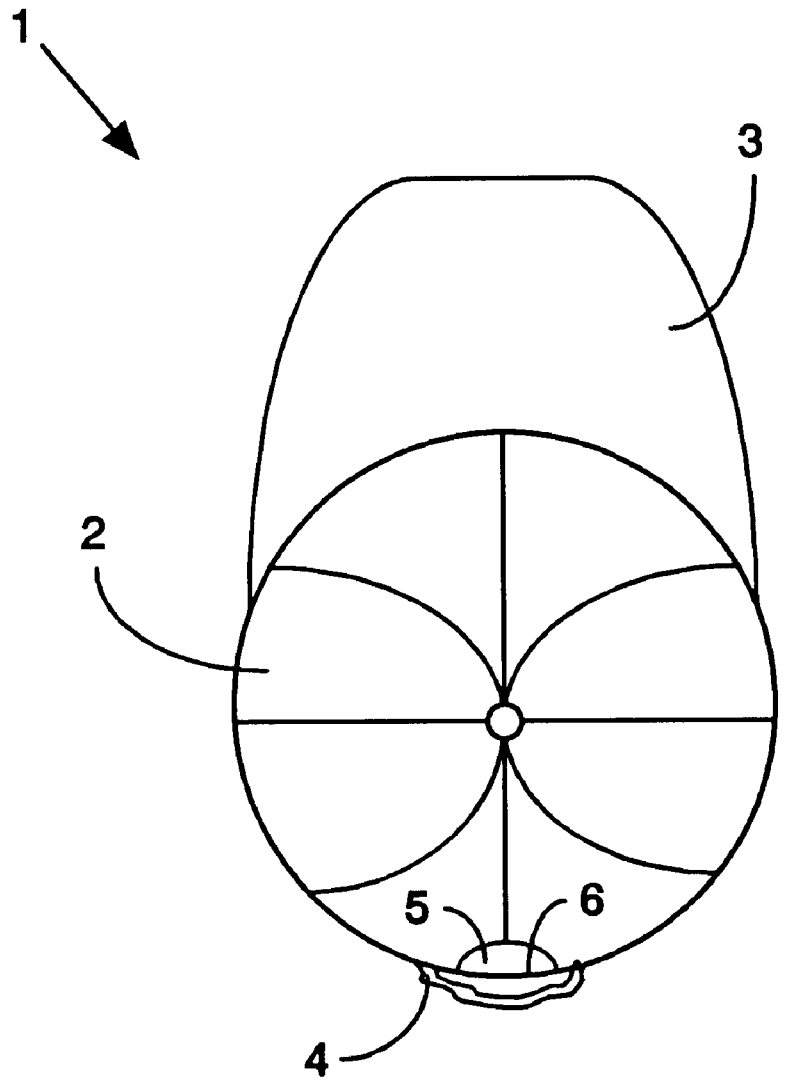
FIG. 2 is a top view of a preferred embodiment of a cap with an integral elastic strap attached to the rear of the cap. This view illustrates the elastic strap in the retracted position.

FIG. 2 is a top view of a preferred embodiment of the cap 1. In this view, the flexible elastic strap 4 is in the retracted position and rests in close proximity to the rear of the cap 1. The elastic nature of the flexible elastic strap 4 allows the flexible elastic strap 4 to go relatively unnoticed when it is not in use because it retracts to a small size and appears to be a portion of the rear of the cap 1.

Also shown in this figure is rear aperture 5. Rear apertures of this type are well known in the art. Aperture 5 performs two functions. First, it allows the circumference of the head band (not shown, head bands are well known it in the art) on the cap 1 to be adjusted to accommodate different size heads. Preferably, an optional retention band 6 would be attached to the head band of the cap 1 at either side of the aperture 5 and would pull on the head band to create a snug fit for the cap 1. Those skilled in the art will recognize that any number of known methods can be used to implement the retention band 6. For example, the retention band 6 can be a fee elastic strap, it can be a pair of adjustable hook and loop strap's, it can be a buckle strap, it can be a pair of straps held by snaps, etc.

Those skilled in the art will realize that if the flexible elastic strap 4 is removably attached to the head band, it can also be used to perform the function of retention band 6. In fact, if the flexible elastic strap 4 is used in this manner, it needs only to be detachable at one end. If the flexible elastic strap 4 is attached in this manner, it can be used as a retention band 6, or alternatively, it can also be used as a hair retention device which is held snugly against the cap 1 when not in use. Attachment of a flexible elastic strap 4 can be accomplished with a variety of known attachment devices, such as hook and loop material, snaps, ties, etc.

The second function provided by aperture 5 is that it provides an opening through which the wearer's hair can be extended. While the size of aperture 5 is not critical, in the preferred embodiment aperture 5 should be sufficiently sized to allow the wearer's hair to comfortably fit through it when the flexible elastic strap 4 is used to secure the user's hair.

Figure 3:
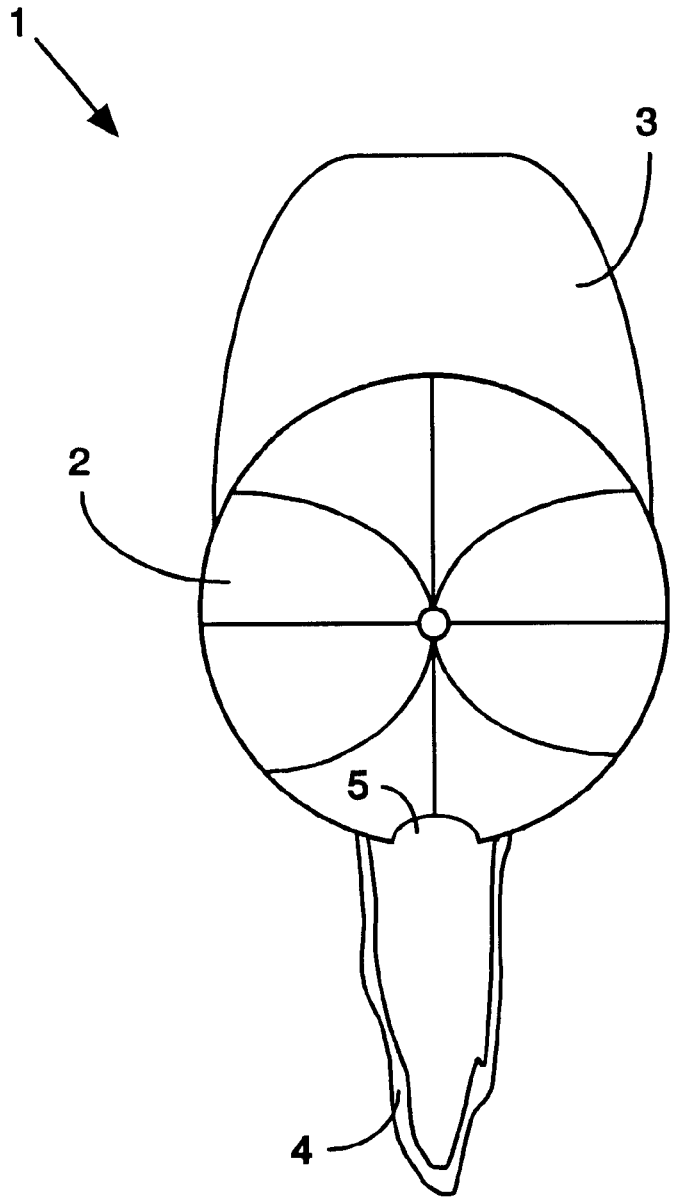
FIG. 3 is a top view of a preferred embodiment of a cap with an integral elastic strap attached to the rear of the cap. This view illustrates the elastic strap in the extended position.

In regard to FIG. 3, this figure illustrates the cap 1, previously discussed in FIG. 2, with the flexible elastic strap 4 in the extended position. This position allows ample room for the wearer's hair to be pulled through, and ample length to wrap around the user's hair of the purpose of securing it in the form a pony tail.

Figure 4:
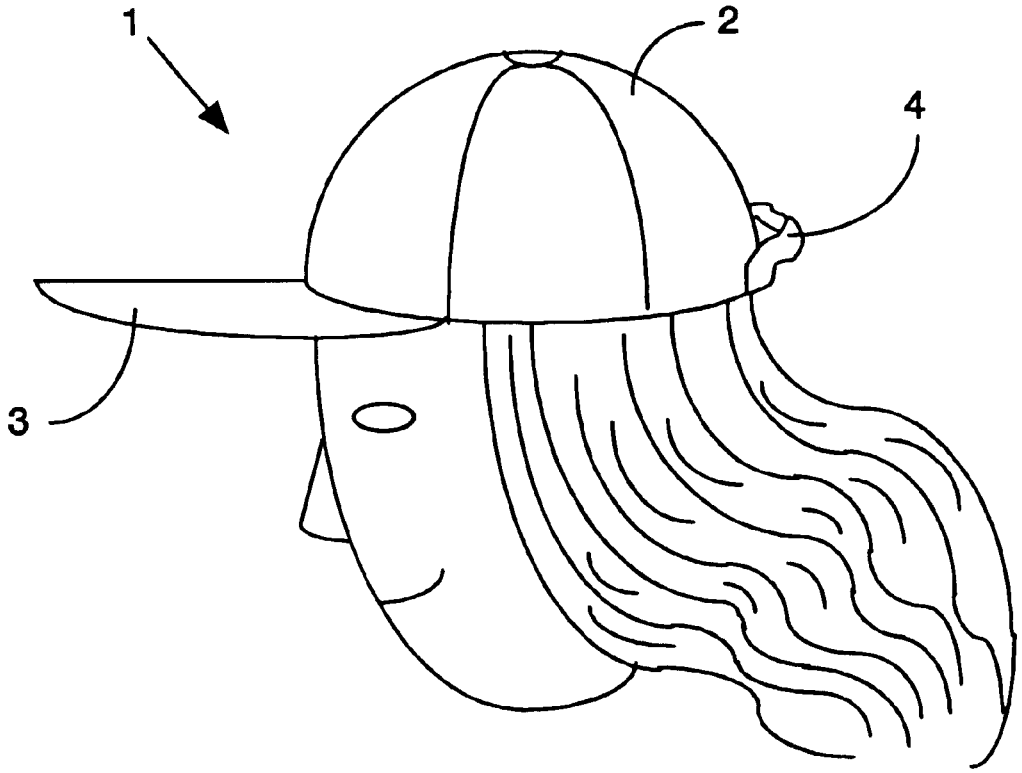
FIG. 4 is a side view of a preferred embodiment of a cap with an elastic strap attached to the rear of the cap. In this view, the cap is shown worn by the wearer with the elastic strap in the retracted position and the wearer is hair down.

Illustrated in FIG. 4 is the cap 1 as it would be worn by an individual. This figure illustrates the cap 1 with the flexible elastic strap 4 in the retracted (e.g. unused) position. In this configuration, the cap 1 functions as a conventional cap and the elastic strap 4 provides an ornamental appearance to the rear of the cap 1. As was discussed above, the flexible elastic strap 4 can be configured such that it rests flat against the wearer's head and appears to be a component of a conventional fact when not in use. Likewise, it can also be fabricated such that it rests loosely against the wearer's head for esthetic reasons. As can be seen, the wearer can use the cap 1 as the wearer would use any conventional hat. Further, even though the flexible elastic strap 4 is not used in this configuration, it is conveniently available for use by the individual at any time. This eliminates the need for the individual to remember to bring an additional device such as a secure their hair in windy conditions or for fashion reasons.

Figure 5A:
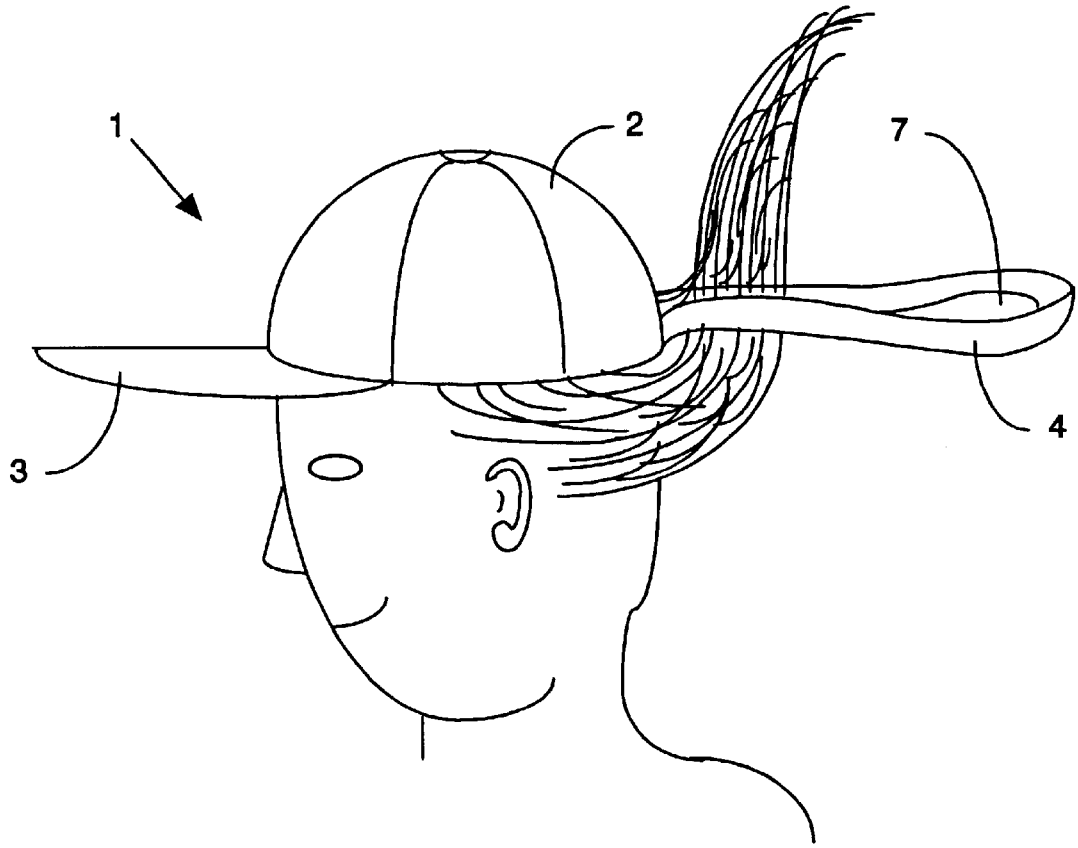
FIGS. 5A–D illustrate a preferred embodiment of the invention which shows how the elastic strap is secured to the wearer's hair.

FIGS. 5A–D illustrate how the flexible elastic strap 4, which is an integral part of cap 1, is secured to the user's hair. In FIG. 5A, the user first pulls her hair toward the back of her head and upward. Then, the cap 1 is placed on the user's head with her hair inserted through a first loop 7 which is formed by extending the flexible elastic strap 4.

Figure 5B:
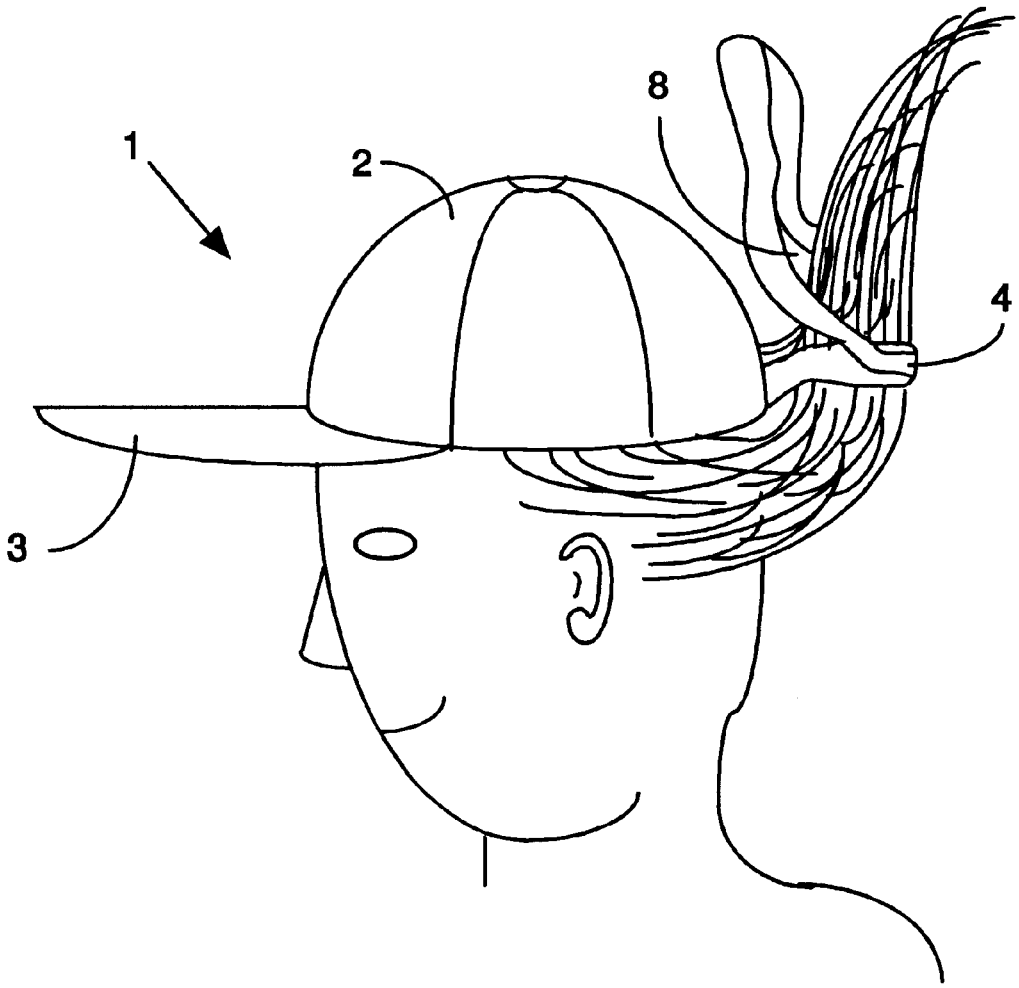

The next step is shown in FIG. 5B. After the hair is pulled through the first loop 7 in FIG. 5A, a second loop 8 is formed by flexible elastic strap 4 when it is twisted to secure the user's hair on one side. Then the user's hair is pulled through second loop 8.

Figure 5C:
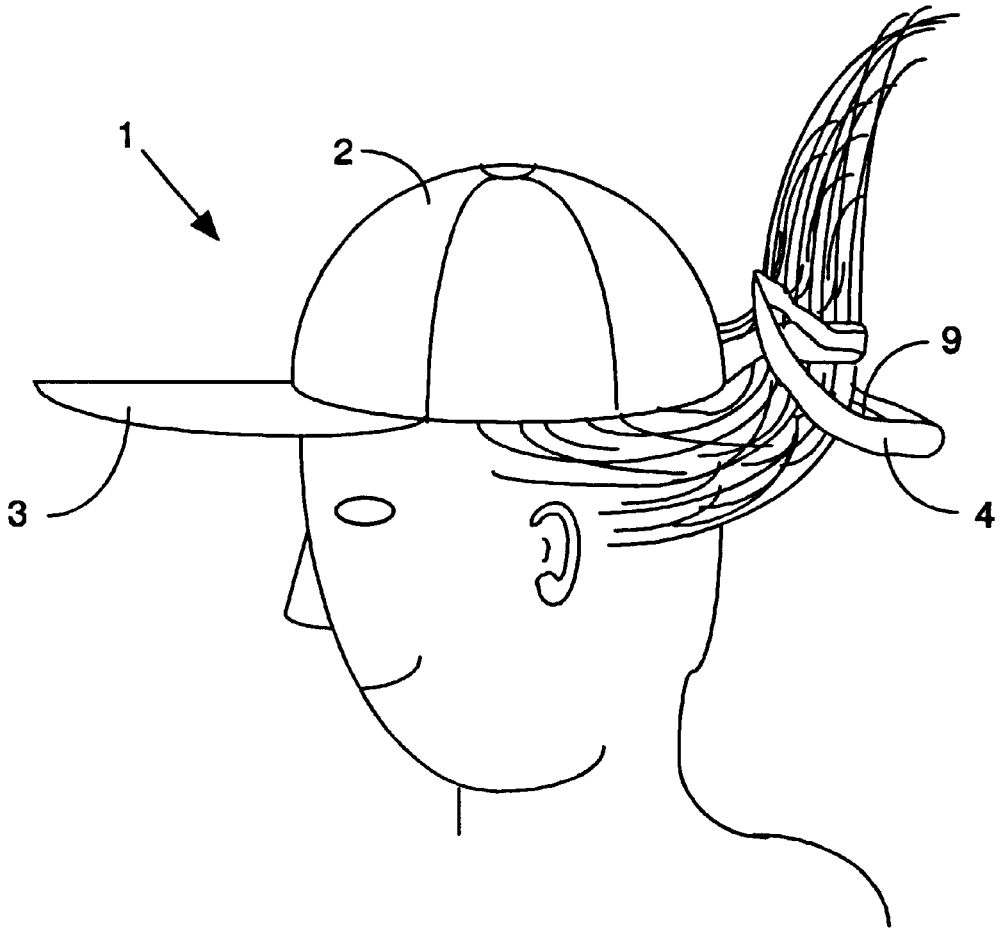

FIG. 5C illustrates the next step in the process. The flexible elastic strap 4 is then twisted again to form a third loop 9 through which the user's hair is again pulled through.

Figure 5D:
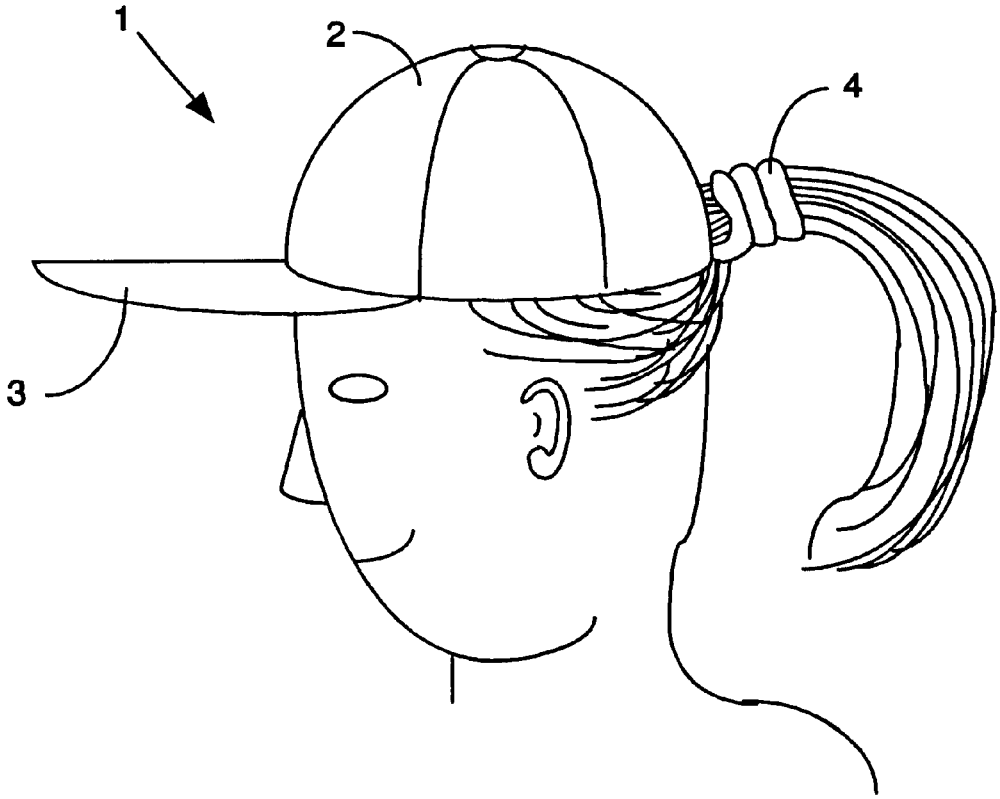

In FIG. 5D, the cap 1 is shown with the flexible elastic strap 4 wrapped around the user's hair to form a pony tail which keeps the hair in place. As can be seen, with the integral flexible elastic strap 4, the wearer of a cap 1 has all the convenience of conventional hair restraint devices with none of the inconvenience of having to carry a second hair restraint device with her.

Figure 6:
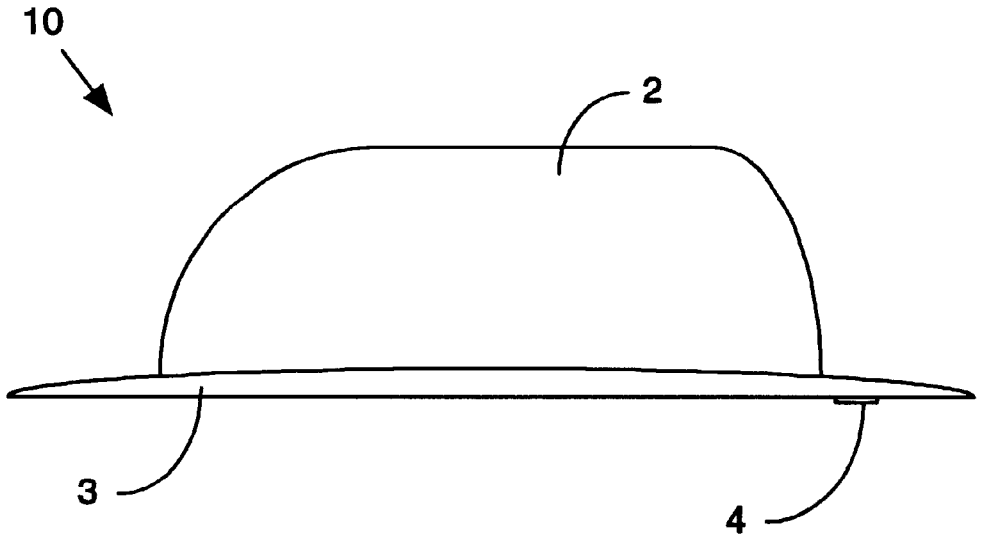
FIG. 6 illustrates an alternative preferred embodiment of the invention which shows how the elastic strap is secured to a conventional hat with a brim that encircles the cap.

In FIG. 6, a preferred embodiment of the invention is implemented in conjunction with a conventional hat 10. This conventional hat 10 can be any style of hat that has a full brim 3 that extends around the periphery of the cap 2. The flexible elastic strap 4 is attached to the rear of the hat 8 on the underside of the brim 3. When not in use, the flexible elastic strap 4 rests against the underside of the brim 3. If the wearer decides to use the flexible elastic strap 4 to secure the wearer's hair, the flexible elastic strap 4 is extended and tied around the wearer's hair as discussed in the previous embodiments. For ease of illustration, the flexible elastic strap 4 is shown attached to the underside of the brim 3. However, those skilled in the art will recognize that the flexible elastic strap 4 could also be secured to the inner hat band such that it would not be visible when not in use.

While the invention has been described with respect to a preferred embodiment thereof, it will be understood by those skilled in the art that various changes in detail may be made therein without departing from the spirit, scope, and teaching of the invention. For example, materials used to fabricate the flexible elastic strap 4 can vary, the method of attachment of the flexible strap 4 to the cap 1 can vary, etc. Accordingly, the invention herein disclosed is to be limited only as specified in the following claims.

I claim:

1. Head wear having an integral hair retention device, comprising:

head wear, having a front portion and a rear portion; and a flexible elastic strap, having first and second ends, and attached at the first and second ends to the rear portion of the head wear, the flexible elastic strap having a retracted position in which it retracts toward the head wear and an extended position in which it is extended outward from the head wear a sufficient distance to encircle a wearer's hair one or more times to secure the hair;

whereby the flexible elastic strap retracts to a retracted position when not in use and extends to secure a wearer's hair when in use.

2. Head wear, as in claim 1, wherein the head wear is a cap.

3. Head wear, as in claim 2, further comprising:

a hat retention band; and wherein the flexible elastic strap rests substantially adjacent to the hat retention band when in the retracted position.

4. Head wear, as in claim 2, wherein the flexible elastic strap acts as a hat retention band when in the retracted position.

5. Head wear, as in claim 2, wherein the flexible elastic strap has sufficient length in the extended position to wrap around the wearer's hair.

6. Head wear, as in claim 5, further comprising an aperture in the rear portion of the cap which has sufficient size to allow access for a portion of the wearer's hair to fit through.

7. A cap having an integral hair retention device, comprising:

a cap for placement on a wearer's head; and a flexible elastic strap having first and second ends which are attached at the first and second ends to the rear portion of the cap, the flexible elastic strap having a retracted position in which it retracts toward the cap and an extended position in which it is extended a sufficient distance to wrap around and secure a wearer's hair;

means to removably attach at least one end of the flexible elastic strap from the cap, such that it can be reattached to the cap at another location to provide a snug fit when in the retracted position;

whereby the flexible elastic strap retracts to a retracted position when not in use and extends to secure a wearer's hair when in use.

8. A cap, as in claim 7, wherein the flexible elastic strap is sufficiently taut in the retracted position such that it holds the cap securely in place on the wearer's head.

9. A cap, as in claim 7, wherein the extended position of the flexible elastic strap is sufficient to wrap around the wearer's hair.

10. A cap, as in claim 9, further comprising an aperture in the rear of the cap to allow access for a selected portion of the hair of the wearer to pass through.

11. A cap, as in claim 7, wherein the flexible elastic strap has a surface with indicia.

12. Head wear, as in claim 1, wherein the head wear is a hat.

13. Head wear, as in claim 12, wherein the flexible elastic strap is concealed in the hat when not in use.

14. A method of securing an individual's hair, including the steps of:

using an item of head wear that has a flexible elastic strap to secure the wearer's hair when the item of head wear is worn by selecting a portion of the wearer's hair that is to be secured, pulling the flexible elastic strap to an extended position and having sufficient length to wrap around the wearer's hair one or more times, and wrapping the hair securing device around the wearer's hair.

15. A method, as in claim 14, including the additional steps of:

using a hat as the item of head wear; and concealing the flexible elastic strap inside the hat when the flexible elastic strap is not in use.

16. A method of securing an individual's hair, including the steps of:

using a cap that has an integral hair securing device to secure the wearer's hair when the item of head wear is worn by selecting a portion of the wearer's hair that is to be secured, pulling the hair securing device to an extended position sufficient to wrap around the wearer's hair, and wrapping the hair securing device around the wearer's hair;

using a flexible elastic strap which has retracted position when not in use and an extended position when extended to wrap around and secure the wearer's hair;

detaching and reattaching at least one end of the flexible elastic strap to the cap such that, when reattached, the flexible elastic strap is snugly held against the cap when in the retracted position.

17. A method as in claim 16, including the additional step of:

providing an aperture in the rear of the cap to allow access for a selected portion of the hair of the wearer to pass through.

18. A method, as in claim 16, including the additional step of:

using a flexible elastic strap which is detachable at both ends such that it is replaceable;

whereby flexible elastic straps can be interchanged to allow indicia for specific events to be displayed.

* * * * *